US011348404B2

(12) United States Patent
Moya Garcia

(10) Patent No.: US 11,348,404 B2
(45) Date of Patent: May 31, 2022

(54) DEVICE FOR CONTROLLING THE OPERATION OF AT LEAST ONE PHYSICAL GAMING MACHINE AND GAMING INSTALLATION COMPRISING THE DEVICE

(71) Applicant: MARCOYPE, S.L., Córdova (ES)

(72) Inventor: Juan Luis Moya Garcia, Córdova (ES)

(73) Assignee: MARCOYPE, S.L., Cordova (ES)

( * ) Notice: Subject to any disclaimer, the term of this patent is extended or adjusted under 35 U.S.C. 154(b) by 0 days.

(21) Appl. No.: 16/820,194

(22) Filed: Mar. 16, 2020

(65) Prior Publication Data

US 2021/0280002 A1 Sep. 9, 2021

Related U.S. Application Data

(63) Continuation of application No. 16/071,580, filed as application No. PCT/ES2016/070315 on Apr. 27, 2016, now abandoned.

(30) Foreign Application Priority Data

Jan. 22, 2016 (ES) ..... ES201630078

(51) Int. Cl.
*G07F 17/32* (2006.01)
*G06Q 50/34* (2012.01)

(52) U.S. Cl.
CPC ..... *G07F 17/323* (2013.01); *G06Q 50/34* (2013.01); *G07F 17/32* (2013.01);
(Continued)

(58) Field of Classification Search
CPC ..... G07F 17/323; G07F 17/3206; G07F 17/3223; G07F 17/3269; G07F 17/3211; G07F 17/3244; G06Q 50/34
See application file for complete search history.

(56) References Cited

U.S. PATENT DOCUMENTS 4,467,424 A * 8/1984 Hedges ..... A63F 13/12 463/26
5,413,357 A 5/1995 Schulze et al.
(Continued)

FOREIGN PATENT DOCUMENTS

WO WO 00/79467 A2 12/2000
WO WO 01/91866 A1 12/2001
(Continued)

OTHER PUBLICATIONS

International Search Report issued by the International Searching Authority (ISA/O.E.P.M.) on Aug. 22, 2016 in connection with International Application No. PCT/EP2016/070315.

*Primary Examiner* — Chase E Leichliter
(74) *Attorney, Agent, or Firm* — Gary J. Gershik

(57) ABSTRACT

The invention relates to a device for controlling the operation of at least one physical gaming machine (1), which comprises at least one digital camera (13) for taking images (5') of a physical viewing display (5) of the gaming machine (1), and telecommunication means (4, 9) for real-time transmission of the images (5') to a remote user terminal (10) comprising a gaming interface (11) for the live and continuous display of the images (5') on a screen (10*a*). The device also comprises remote selecting means (7*a'*, 7*b'*, 7*c'*, 7*d'*), analogous to physical selector means (7*a*, 7*b*, 7*c*, 7*d*) of the gaming machine (1), which allow a remote player to select remote commands relating to the game and which are transmitted by means of a remote server (3) to a control module (12) connected to a control logic (2) of the gaming machine (1) to automatically block the remote commands when the gaming machine (1) is activated by an on-site player (6), and to block in the gaming machine, on-site selection commands, payout processing means (2*c*) and payment processing means (2*b*) and activate at least the
(Continued)

selection process module (2*a*) in remote-gaming mode, when the gaming machine (1) is activated by the remote player.

26 Claims, 9 Drawing Sheets

(52) U.S. Cl.
CPC ..... *G07F 17/3206* (2013.01); *G07F 17/3211* (2013.01); *G07F 17/3213* (2013.01); *G07F 17/3223* (2013.01); *G07F 17/3244* (2013.01); *G07F 17/3269* (2013.01)

(56) References Cited

U.S. PATENT DOCUMENTS 5,611,730 A * 3/1997 Weiss ..... G07F 17/32 463/20
5,797,795 A * 8/1998 Takemoto ..... G07F 17/3227 463/42
5,800,268 A * 9/1998 Molnick ..... G07F 17/32 463/40
5,830,067 A * 11/1998 Graves ..... G07F 17/32 463/40
6,001,016 A * 12/1999 Walker ..... G07F 17/32 463/20
6,080,063 A 6/2000 Khosla
7,753,792 B2 * 7/2010 Walker ..... G07F 17/3262 463/42
RE44,439 E * 8/2013 Rafaeli ..... A63F 3/00157 463/25
9,129,489 B2 9/2015 Froy, Jr. et al.
10,055,931 B2 * 8/2018 Greenbaum ..... G07F 17/3225
10,818,127 B2 * 10/2020 Greenbaum ..... G07F 17/3223
2003/0109306 A1 * 6/2003 Karmarkar ..... G07F 17/3218 463/40
2006/0025209 A1 * 2/2006 Walker ..... G07F 17/3232 463/25
2006/0172794 A1 * 8/2006 Walker ..... G07F 17/32 463/20
2006/0217199 A1 9/2006 Adcox et al.
2009/0054131 A1 * 2/2009 Jacobson ..... G07F 17/3281 463/25
2011/0218028 A1 9/2011 Acres
2013/0288778 A1 10/2013 Johnson
2014/0256407 A1 * 9/2014 Graf ..... G07F 17/3225 463/22

FOREIGN PATENT DOCUMENTS

WO WO 02/055163 A2 7/2002
WO WO 2015/071909 A1 5/2015

* cited by examiner 17
5a
5b
5c
1
16
7
2
7
1a
7d
5
7a
7b
7c
1b
1d
1c
16
5a
5b
5c
16
16
7
2
7
5
10a
11
16'
5b'
5a'
7
2
7
5'
5b'
13
7b'
7a'
7c'
14
7d'
14
3d
10
3c

DEVICE FOR CONTROLLING THE OPERATION OF AT LEAST ONE PHYSICAL GAMING MACHINE AND GAMING INSTALLATION COMPRISING THE DEVICE

CROSS-REFERENCE TO RELATED APPLICATIONS

This application is a continuation of U.S. Ser. No. 16/071,580 a § 371 national stage of PCT/ES2016/070315, filed Apr. 27, 2016, claiming priority of Spanish Patent Application No. P 201630078, filed Jan. 22, 2016, the contents of each of which are hereby incorporated by reference into this application.

TECHNICAL FIELD OF THE INVENTION

The present invention belongs to the technical field of gaming machines governed by a programmable electronic control logic and of the control systems of such machines.

PRIOR ART

Gaming machines, also referred to as "slot machines" have been known for many years. These are machines in which the on-site player pays a certain amount of money for gambling during a certain period of time on combinations of signs, such as symbols, numbers and/or letters, that are displayed on a physical viewing display, to obtain game time credits and possibly a cash prize, based on combinations that appear in succession on the physical display in individual fields. Known gaming machines include those having, for example, physical viewing displays in the form of viewing windows through which the player can view rotating rollers provided with signs, or electronic viewing screens displaying signs, for example in the form of a "virtual rollers", and that in some machines are touch-sensitive. Some gaming machines further comprise additional electronic screens designed to show the player additional information, such as the state of the credits, the existence of prizes, secondary games, entertainment videos, etc. The on-site player is able to interact with the machine by means of selectors such as buttons, switches, levers, touch fields on an electronic touch screen, etc., to individually or collectively change the signs that make up each combination of signs that appears in the fields on the physical viewing display. These machines are usually available at hospitality premises and in gaming halls, bingo halls and casinos.

Nowadays gaming machines are highly sophisticated devices governed by a programmable electronic control logic, such as for example a CPU. A typical machine of this type comprises a physical viewing display to show an on-site player information on gaming stages as well as physical selector means to allow the on-site player to select on-site commands available with respect to a game session of the game. The on-site commands are processed by a selection process module integrated in the control logic. These machines also comprise payment processing means to activate the gaming machine when an on-site player has paid a price to be able to play the game and payout processing means to pay prizes to the on-site player he has won at least one game session of the game from the gaming machine. The physical viewing display, the physical selector means, the payment processing means, the payout processing means and the first telecommunication means are connected to the electronic control logic.

It is increasingly common that gaming machines are provided with telecommunication means by which data can be exchanged between the control logic of the gaming machine and a remote server, for example to perform diagnostics of the machine operation, reprogramming and machine status checks, or interconnections between several machines.

Gaming machine enthusiasts need to go to the place where machines are located to be able to play. This is in some cases impossible, or annoying. To avoid this, there are on-line gaming systems in which the player interacts with a virtual gaming machine that is displayed on the screen of his smartphone, tablet or computer. However, many players are wary of these virtual gaming machine systems. Other players prefer to play on "their" gaming machine(s) and, therefore, cannot play games without going to the location of the gaming machine(s) of their choice.

DESCRIPTION OF THE INVENTION

The object of the present invention is to overcome the drawbacks of the prior art by means of a device for controlling the operation of at least one physical gaming machine governed by a programmable electronic control logic, comprising a remote server and first telecommunication means to exchange data between the gaming machine and a remote server, wherein the gaming machine comprises a physical viewing display to show an on-site player information on gaming stages, physical selector means to allow the on-site player to select on-site commands available with respect to a game session of the game, a selection process module integrated in the control logic, to process the on-site commands selected by the on-site player, payment processing means for activating the gaming machine when an on-site player has paid a price to be able to play the game, status collection means integrated in the control logic that capture position signals, which identify positions of the images displayed on the physical viewing display at each time, payment processing means to pay prizes to the on-site player when he has won at least one game session of the game from the gaming machine, the physical viewing display, the physical selector means, the payment processing means, the payout processing means and the first telecommunication means being connected to the electronic control logic.

and the control device further comprising at least one digital camera for the real-time taking of images at least of the physical viewing display of the gaming machine connected to image transmission means;

second telecommunication means to perform interactive wireless communications of data related to the game, between the remote server and at least one remote player terminal of a remote player, and for the real-time transmission of the images of the physical viewing display to the remote user terminal;

a gaming interface that, at least when it is in communication with the remote server, shows in real time on a screen of the remote player terminal, the images of the physical viewing display transmitted by the image transmission means, as well as remote selecting means analogues to the physical selector means, and allows the remote player to select, on the remote player terminal, commands available in game session stages of the game and transmit them, through the second telecommunication means and in real time to the remote server;

a control module connected to the control logic of the gaming machine for automatically blocking, when receiving the relevant blocking commands from the remote server, at least the activation of remote selection commands when the gaming machine is activated by an on-site player, and for automatically blocking at least the activation of the on-site selection commands, the payout processing means and the payment processing means and for activating at least the selection process module in remote gaming mode, when the gaming machine is activated by the remote player, the image transmission means being integrated in the control module;

selection process means, integrated in the remote server, for the real-time processing of commands selected by the remote player in the gaming interface of the remote player terminal, and for real-time transmission of the selected commands processed to the control module via the first telecommunication means;

an accounts manager module integrated in the remote server, to manage collections and payments in the respective accounts of remote players.

The invention further relates to a gaming installation comprising at least one gaming machine of the type described above and the control system with the characteristics described above, and optionally with one or more characteristics that will be described below.

The control device according to the present invention allows a player to play on a gaming machine located on given premises, remotely, and in real-time, which obviously includes the slight delays that occur inevitably due to the need to process data and perform data transmission via telecommunication means through the remote player terminal, such as for example a smart phone, a desktop or laptop computer, or a computer from another location remote from the gaming machine, when no one else is playing on-site on the gaming machine. Thus the player can see the gaming machine and the games he is playing "live".

Preferably, the digital camera(s) are digital cameras with high video resolution, capable of capturing video images and photos. Several cameras may be provided installed such that their imaging fields do not include blind spots.

The digital camera(s) may be arranged to capture images of the physical viewing display of the gaming machine only or, in addition to the physical viewing display, of a wider part of the gaming machine, such as one or more additional electronic screens designed to show the player additional information, such as the state of the credits, the existence of prizes, secondary games, entertainment videos.

On the other hand, the control device also enables to take advantage of the security and reliability offered by the gaming machines which, as is known, are very strictly controlled in their compliance with the applicable regulations.

The accounts manager module communicates with a virtual bank which manages, in a way known in itself, the payments and collections in a remote user account, user who can give his commands on the payment and collection of prizes via his remote user terminal. Collection and payment commands include the possibility of betting the prizes received on a new play or game session.

The remote server preferably comprises a control server and a video server. The control server controls the functionalities of the system, stores data transmitted between the gaming machine and the remote server, images taken by the digital camera, data transmitted between the remote server and the remote player terminal, and routes the images to the respective remote player terminals from which the remote players are playing on different gaming machines. In turn, the video server collects the images captured by the digital cameras and transmits them to the respective remote player terminals indicated by the control server. This separation of servers contributes to the proper functioning of the system and is a measure of security.

In one embodiment of the invention, the control module comprises first and second blocking means. The first blocking means are designed for blocking at least the activation of the remote selection commands when the gaming machine is activated by an on-site player. In turn, the second blocking means are designed for automatically blocking at least the activation of the on-site selection commands, the payout processing means and the payment processing means, when the gaming machine is activated by the remote player.

Preferably, the control module further comprises status transmission means that collect the position signals captured by the status collection means, identifying the positions of the images displayed on the physical viewing display, and transmit them to the control server.

The control module can be integrated in the control logic of the gaming machine, or may be an external unit connected to the control logic of the gaming machine, in compliance with the approval standards of the gaming machine.

When the control module is an external unit, it may comprise a programmable central processor/controller, such as for example an Intel or AMD processor, to carry out operations remotely, with an Ethernet or similar integrated interface from which it is possible to check and control the sign-ins and outs from web browsers, which are preferably housed in a box or container, for example of made of aluminium or plastic material, such as PVC, with thermal, electric and electromagnetic insulation and that for radio frequency waves or similar.

The control module may comprise a motherboard attached to the box or container by means of conventional fastening elements, such as insulated metal screws, pins, self-locking rotation pins, housed in the fastening holes of the board. The box may be provided with a security seal.

On the motherboard, independent units can be mounted, for example by means of "PCI slot"-type connectors, independent units such as

- a connection unit designed to connect the control module to the control logic of the gaming machine,
- a first blocking activation unit designed to integrate the first blocking means of the remote selecting commands when the gaming machine is activated by an on-site player,
- a second blocking activation unit designed to integrate the second blocking means of the physical selector means of the gaming machine when activated by a remote player,
- a remote activation unit, designed to activate the payment collection processing means, the payment processing means, and the selection process module when the gaming machine is activated by a remote player,
- an image transmission unit designed to be activated and transmit the images of the video camera when the gaming machine is activated by a remote player.

Moreover, the central processor may be mounted on a socket connected to the motherboard by micro-welding, or directly on the motherboard. Also, the external unit preferably comprises a power source that can form part of the motherboard, either integrated in the motherboard itself with its components welded thereto, or, preferably, as a separate unit housed in the box and connected to the electricity mains through a connector, for example, a filter connector base or similar.

One or more ports can also be mounted on the motherboard to provide the necessary connectivity for the operation of the control device. These ports can be selected from among ports such as USB, HDMI, OPTO-DIGITAL, SERIAL, PARALLEL, which can be firmly mounted, for example by welding, to the motherboard.

Preferably, both each of the aforementioned ports and the connector of the power supply to the mains are arranged such fhat they are accessible from the outside of the box or container and constituting the only points of access to the control module.

The control module may comprise a recognition unit programmed to issue a blocking signal which prevents activation of the gaming machine from the remote player terminal when the digital camera(s) do not capture video images of the physical viewing of the gaming machine. This can be, for example, when someone is situated between the digital camera and the physical viewing display of the gaming machine.

The digital cameras are mounted on the gaming machine or, alternatively, at a location distanced from the gaming machine, for example on the ceiling or on the wall of a room.

The first telecommunication means can comprise a 3G or 4G-technology mobile telephone device for example. Alternatively, or additionally, the first telecommunication means can be adapted to establish data transmission with the remote server via a fixed telephone line.

At least part of the gaming interface is programmed on the remote player terminal, such as for example in the form of an application ("app"), or may be at least partially hosted on the remote server so that it is only displayed on the remote player terminal when it is connected to the remote server. The gaming interface may also comprise other functionalities, such as for example a stand-by application that allows sending an alphanumeric code to a stand-by module integrated in the control module in order to maintain the physical gaming machine on stand-by for a short predetermined time. This latter application is useful when the remote player has to stop playing on the gaming machine for some reason, but wishes to resume the game, the game session, or the play in the same state as it was when he had to put it on stand-by.

The control module may further comprise other additional statistics utilities, such as counters for example of ingoing payments made by on-site and/or remote users, counters for example of outgoing prizes paid, evaluators of prize percentages on payments, collectors of the amounts of bets placed, internal checks of control module element operation, counters of operating hours, log of incidents, for example down-time hours out of service, access to the module, access to the replay of last plays (for example the last 100 plays), access/opening control checks for slot machines, etc.

As is apparent from the above description, the present invention makes it possible to remotely play game sessions on an actual physical gaming machine and, therefore, satisfactorily solves the drawbacks of the remote gaming systems of the prior art.

BRIEF DESCRIPTION OF THE DRAWINGS

Described hereunder are embodiments of the invention based on schematic drawings, in which.

Figure 1:
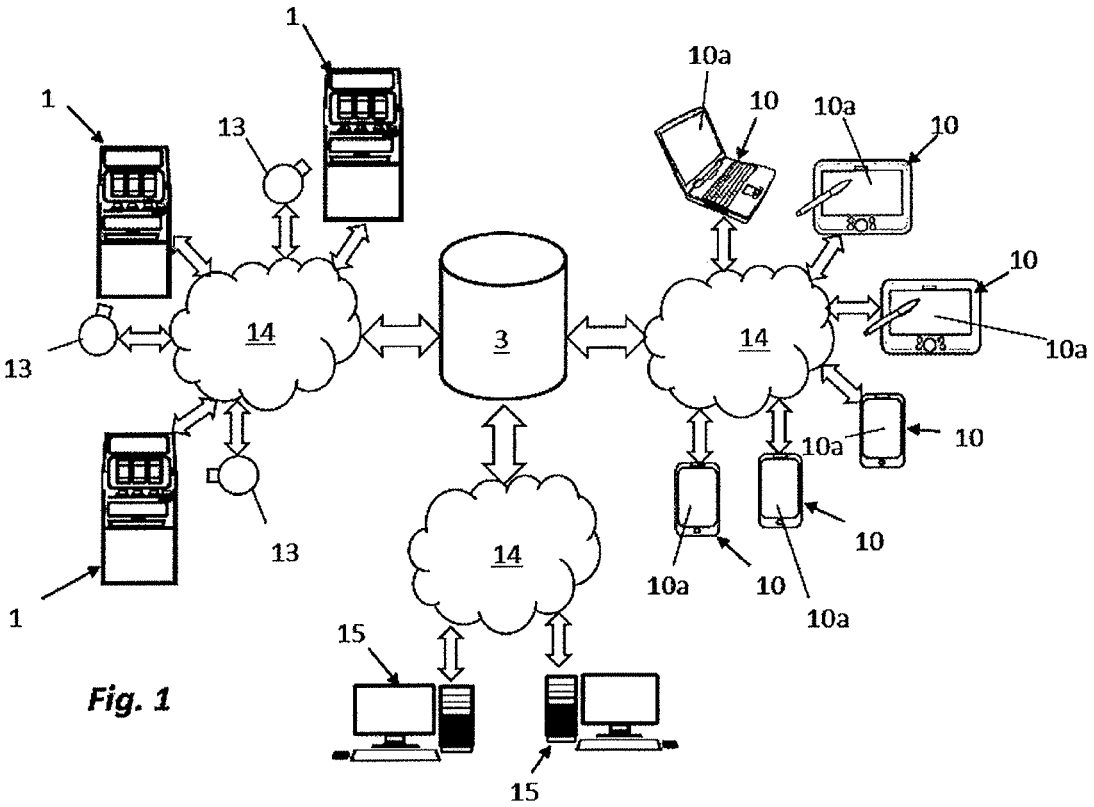
FIG. 1 shows the main components of an embodiment of a gaming installation that incorporates a control device according to the invention.

These figures show signs of reference identifying the following elements:

1 gaming machine
1*a* slot for inserting coins
1*b* slot for inserting notes
1*c* delivery tray
1*d* outlet
2 control logic
2*a* selection process module
2*b* payment processing means
2*c* payout processing means
2*d* status collection means
3 remote server
3*a* selection process means
3*b* accounts manager module
3*c* control server
3*d* video server
4 first telecommunication means
5 physical viewing display
5*a*, 5*b*, 5*c* display fields
5*a*', 5*b*', 5*c*' field images
5' images
6 on-site player
7*a*, 7*b*, 7*c*, 7*d* physical selector means
7*a*', 7*b*', 7*c*', 7*d*' remote selecting means
7*a*", 7*b*", 7*c*", 7*d*" image of the physical selector means
8 image transmission means
9 second telecommunication means
10 remote player terminal
10*a* screen
11 gaming interface
12 control module
12*a* first blocking means
12*b* second blocking means
12*c* status transmission means
13 digital camera
14 internet
15 personal computers
16 rotating rollers

16' image of the rollers
17 additional electronic screen
17' indication
17" image of the additional electronic screen
18 power source
19 connection unit
20 first blocking unit
21 second blocking unit
22 remote activation unit
23 image transmission unit
24 central processor
25 connection port

EMBODIMENTS OF THE INVENTION

In the embodiment illustrated in FIG. 1, the gaming device comprises a remote server -3- connectable by the Internet -14-, to three physical gaming machines -1-, to three high-resolution digital cameras -13- capable of capturing video images, to a couple of personal computers -15-, and to six remote player terminals -10- each one comprising, in itself conventionally, a screen -10*a*.

The gaming machines -1- can exchange data with the remote server -3- via a secure internet -14- connection. On the other hand, each gaming machine -1- is assigned one of the digital cameras -13- which focuses on the physical viewing display of the gaming machine -1-. The video images captured by each digital camera -13- are also transmitted to the remote server -3-.

The remote server -3- transmits images captured by the digital camera -13- assigned to the gaming machine -1- chosen by a remote player so that he can observe on his remote terminal -10- different symbols, letters and/or numbers appearing on the physical viewing display of the gaming machine -1-.

Figure 2:
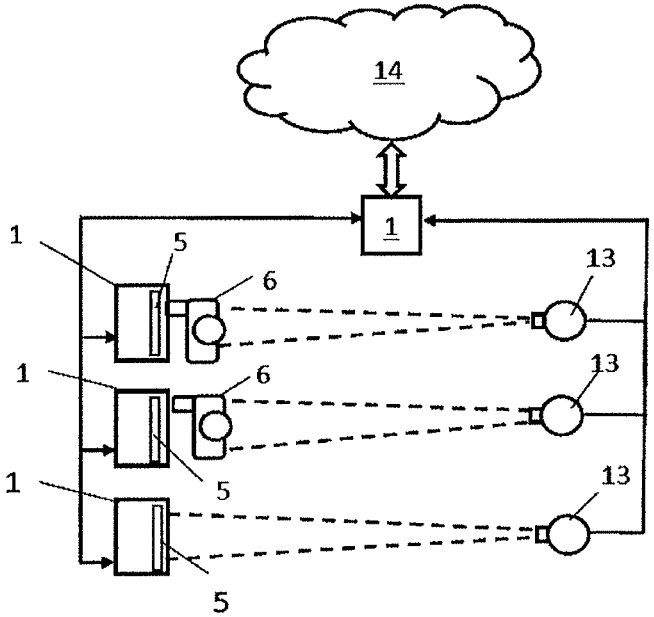
FIG. 2 shows gaming machines and their connection to components of the control device.

FIG. 2 shows the arrangement of three gaming machines -1- and three digital cameras -13- in a gaming hall. The digital cameras -13- are mounted oppositely to the physical viewing displays -5- of the gaming machines -1- and in such a manner that each of the digital cameras -13- focuses at least on the physical viewing display -5- of the gaming machine -1- it is assigned to. The digital cameras -13- and the control logic of the gaming machines -1- are connected via an external control module -12- to the first telecommunication means, through which the data transmission passes to the remote server.

According to what is illustrated in FIG. 2, two of the three gaming machines -1- are being used by two on-site players -6- who therefore conceal the physical viewing displays -5- of these gaming machines -1-, so the two digital cameras -13- assigned to these gaming machines -1- cannot capture images of said displays -5-. Given that the control module comprises a recognition unit (not shown in FIG. 2) programmed to issue a blocking signal which prevents activation of the gaming machine -1- from the remote player terminal when the digital camera -13- does not capture video images of the physical viewing display -5- of the gaming machine -1-, the two gaming machines -1- used on site, of whose physical viewing displays -5- the digital cameras -13- cannot capture images, will not be accessible by remote players, since the control module -12- has issued and transmitted blocking commands to the remote server, to block the activation of the remote selection commands. In this way, only the third gaming machine -1- that is not being used by an on-site player -6- is available for remote players.

Figure 3:
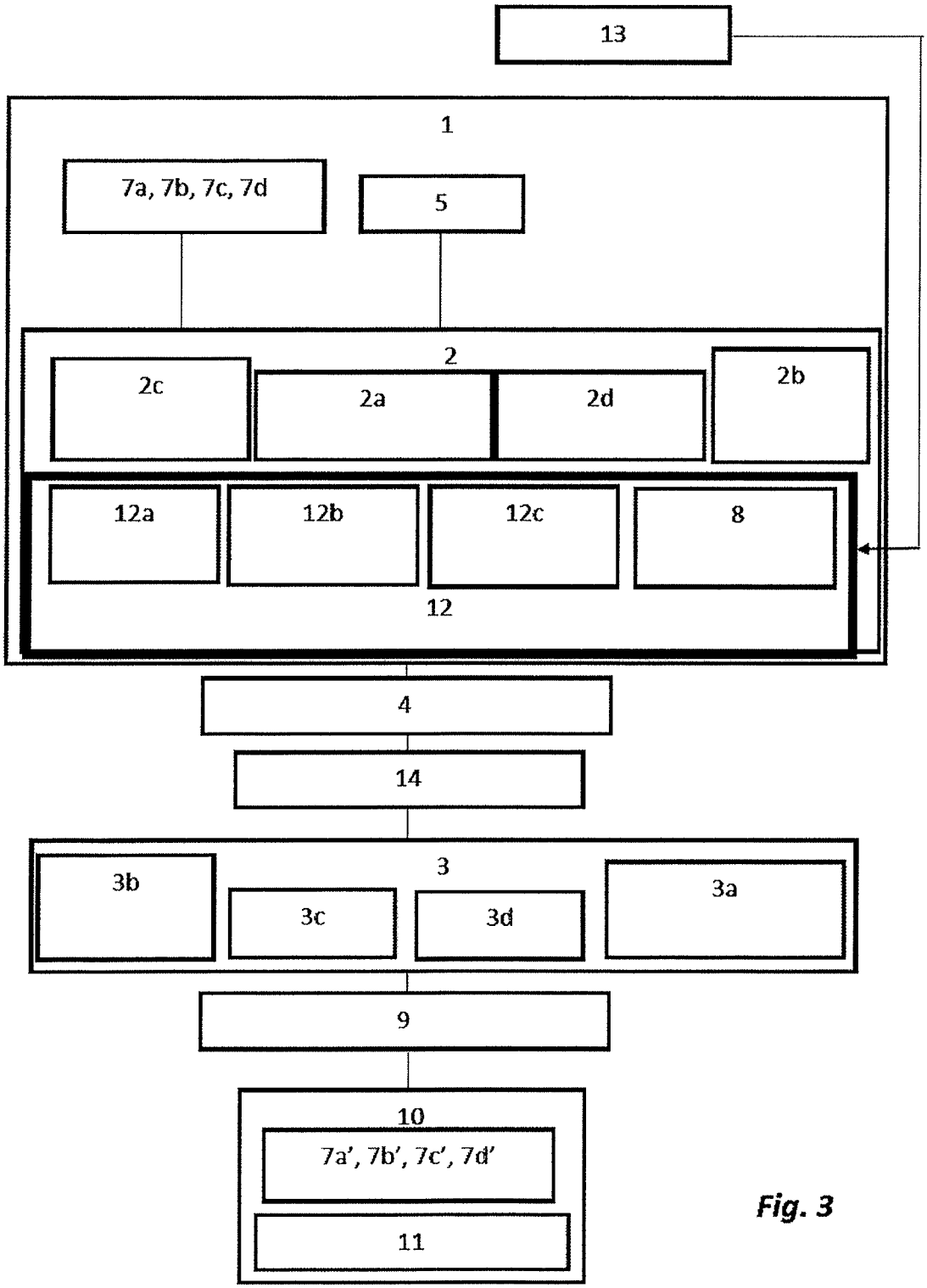
FIG. 3 shows basic components of an embodiment the control device for a gaming machine and a remote player terminal.

The control device illustrated in FIG. 3 shows basic components involved in the implementation and control of the game sessions played by on-site and remote players. It is noted that the gaming machine -1- comprises a physical viewing display -5-, physical selector means -7*a*, -7*b*, -7*c*, 7*d*-, a selection process module -2*a*-, payment processing means -2*b*-, payout processing means -2*c*-, and status collection means 2*d*- integrated in a programmable electronic control logic -2- that governs the functions of the gaming machine -1-. The gaming machine -1- can connect to a remote server -3- via first telecommunication means -4- to transmit data between the gaming machine -1- and the remote server -3-.

The physical viewing display -5- is designed to display an on-site player information on gaming stages, which can be influenced by an on-site player by entering on-site commands by means of the physical selector means -7*a*, 7*b*, 7*c*, 7*d*-, such as buttons, switches, levers, touch fields on an electronic touch screen, etc. The results of the game stages are shown on the physical viewing display -5-.

The programmable electronic control logic -2- comprises the selection process module -2*a*-, the payment processing means -2*b*-, the payout processing means -2*c*- and the status collection means -2*d*-. The selection process module -2*a*- is integrated in the control logic -2-, to process the on-site commands selected by the on-site player, while the payment processing means -2*b*- are designed to activate the gaming machine -1- when an on-site player has paid a price to be able to play the game. On the other hand, the payout processing means (2*c*) are provided to pay prizes to the on-site player when he has won at least one game session of the game from the gaming machine -1-. Status collection means -2*d*- capture position signals, which identify positions of the images displayed on the physical viewing display -5- at each time.

The physical viewing display -5-, the physical selector means -7*a*, 7*b*, 7*c*, 7*d*-, and the first telecommunication means -4- are connected through the control logic -2-.

At a distance from the gaming machine -1- a digital camera -13- is arranged that focuses on the physical viewing display -5- to take video images -5'- in real time of the physical viewing display -5- of the gaming machine -1-. The digital camera -13- is connected to the image transmission means -8- (FIG. 2).

Second telecommunication means -9- are also provided to perform interactive wireless communications of data related to the game, between the remote server -3- and at least one remote player terminal -10- of a remote player, and for the transmission of images -5'- of the physical viewing display -5- to the remote server -3-. In the remote player terminal -10- a gaming interface -11- is programmed which, at least when in communication with the remote server -3-, shows the images -5'- of the physical viewing display -5- on a screen -10*a*- of the remote player terminal -10-, as well as remote selecting means -7*a*', 7*b*', 7*c*', 7*d*'- analogous to the physical selector means -7*a*, 7*b*, 7*c*, 7*d*-, and allows the remote player to select, on the remote player terminal -10-, commands available in the stages of the game session of the game and transmit them to the remote server -3-.

A control module -12- is connected to the control logic -2- of the gaming machine -1- to automatically block, when receiving blocking commands from the remote server -3-, at least the activation of the remote selection commands when the gaming machine -1- is activated by an on-site player, and to automatically block at least the activation of on-site selection commands, the payout processing means -2*c*- and the payment processing means -2*b*-, when the gaming machine -1- is activated by the remote player. Also provided is an accounts manager module -3*b*- integrated in the remote server -3-, to manage collections and payments in the respective accounts of remote players. In the embodiment illustrated in FIG. 3, the control module -12- is integrated in the control logic -2- of the gaming machine -1-.

The control module -12- comprises first blocking means -12*a*- to block at least the activation of the remote selection commands when the gaming machine -1- is activated by an on-site player; as well as second blocking means -12*b*- to automatically block at least the activation of the on-site selection commands, the payout processing means -2*c*- and the payment processing means -2*b*-, and to activate at least the selection process module -2*a*- in remote gaming mode, when the gaming machine -1- is activated by the remote player.

The image transmission means -8- to which the digital camera 13 is connected are integrated to the control module -12- and are in communication with a recognition unit (not shown in FIG. 3) which is programmed to issue a blocking signal that prevents activation of the gaming machine -1- from the remote player terminal -10- when the digital camera -13- does not capture images -5'- of the physical viewing display -5- of the gaming machine -1-.

The control module -12- further comprises status transmission means -12*c*- that collect the position signals captured by the status collection means -2*d*-, identifying the positions of the images displayed on the physical viewing display -5-, and transmit them to the control server -3*c*-. The remote server -3- comprises a control server -3*c*- and a video server -3*d*-. The control server -3*c*- is designed to control system functionalities, store data transmitted between the gaming machine -1- and the remote server -3-, control and store the images -5'- taken by the digital camera -13- control and store data transmitted between the remote server -3- and the remote player terminal -10-, and route the images -5'- and position signals to the respective remote player terminals -10- that are playing on the different gaming machines -1-. On the other hand, the video server -3*d*- is designed to collect the images -5'- captured by the digital cameras -13- and transmit them in real time to the respective remote player terminals -10- indicated by the control server -3*c*-. The remote server -3- further comprises selection process means -3*a*- for the real-time processing of commands selected by the remote player in the gaming interface -11- of the remote player terminal -10-, and for real-time transmission of the selected commands processed to the control module -12- via the first telecommunication means -4-.

Figure 4:
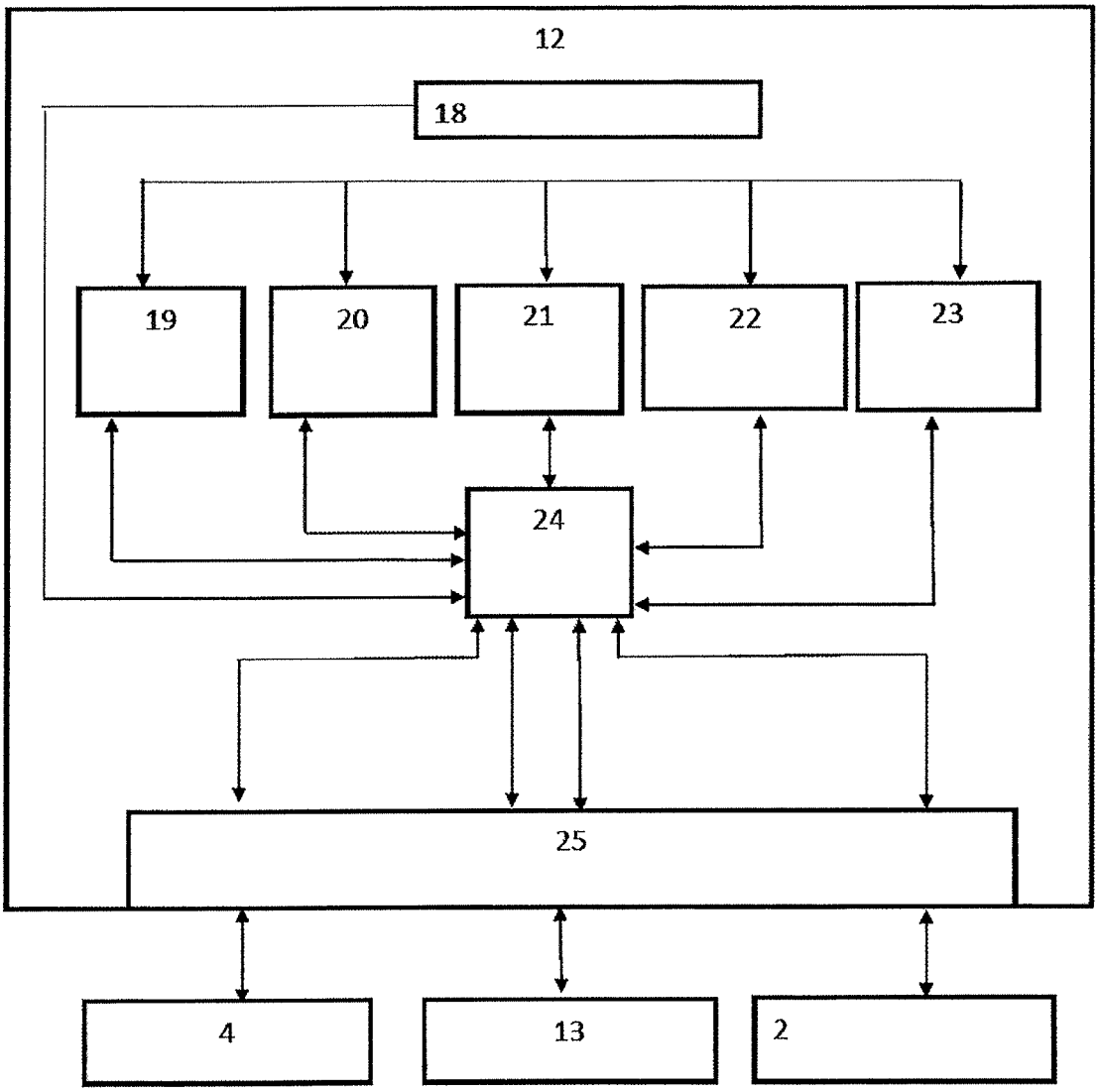
FIG. 4 shows a flow diagram relating to the basic components shown in FIG. 3.

FIG. 4 shows an embodiment of a control module designed as an external unit comprising a power source, a connection unit -19-, a first blocking activation unit -20-, a second blocking activation unit. -21-, a selector activation unit -22-, an image transmission unit -23- connected to a central processor -24- which in turn is connected to the first telecommunication means -4-, the camera- 13- and the control logic -2- of the gaming machine through connection ports -25-. The central processor -24- governs and controls the functions of the units -19, 20, 21, 22, 23-. In FIG. 4 the unidirectional communications between the various elements are represented by simple arrows and the bidirectional communications by double arrows.

As can be seen, the power supply -18- supplies electrical energy to the control module -12-, particularly to the connection unit -19-, the first blocking unit -20-, the second blocking unit -21-, the remote activation unit -22-, the image transmission unit -23- and the central processor -24-. The connection unit -19- is designed to connect the control module -12- to the control logic -2- of the gaming machine. The first blocking activation unit -20- is designed to integrate the first blocking means (12*a*- see FIG. 3) of the remote selection commands when the gaming machine is activated by an on-site player, while the second blocking activation unit -21- is designed to integrate the second blocking means (12*b*- see FIG. 3) of the physical selector means of the gaming machine when it is activated by a remote player.

The remote activation unit -22- is designed to activate the payment collection processing means -2*b*-, the payout processing means -2*c*-, and the selection process module -2*a*- when the gaming machine is activated by a remote player. In turn the image transmission unit -23- is designed to be activated and transmit the images of the camera -13- when the gaming machine is activated by a remote player.

The central processor -24- controls and governs the functions of the units -19, 20, 21, 22, 23- and communicates bidirectionally both with said units -19, 20, 21, 22, 23- and, via the ports -25-, with the first telecommunication means -4-, with the camera -13- and with the control logic -2- of the gaming machine. The ports -25- can be ports such as USB, HDMI, OPTO-DIGITAL, SERIAL, PARALLEL.

FIGS. 5 to 10 illustrate the flow of data between the remote player terminal -10-, the remote server -3-, the gaming machine -1- and the digital camera -13-, in consecutive stages of a game session, in which the game session is being played by a remote player. In these stages, the digital camera -13- continuously captures video images -5'- of the physical viewing display -5- of the gaming machine -1-. The video images -5'- and the position signals are transmitted continuously and in real time to the remote server -3- and from there they are transmitted, also continuously and in real time, to a remote user terminal -10-. Likewise, the interactions between the remote user terminal -10- and the gaming machine -1- are always carried out in real time.

The gaming machine -1- comprises, conventionally in itself, a physical viewing display -5- with three separate fields -5*a*, 5*b*- 5*c*- displaying the three numbers that make up a first combination of numbers. The numbers are conventionally marked on respective rotating rollers -16-. The gaming machine further comprises an additional electronic display -17- intended to show the player additional information, such as the status of credits, the existence of prizes, secondary games, entertainment videos, etc.

The gaming machine -1- has three physical individual selection buttons -7*a*, 7*b*, 7*c*-, each assigned to one of the fields -5*a*, 5*b*, 5*c*- so that the on-site player can, by pressing the corresponding button, put the roller -16- in rotation to change the number of the field the button is assigned to.

The gaming machine -1- also has a physical general selection button -7*d*- so that the on-site player can rotate all the rollers -16- at the same time and thus change all the numbers at the same time, simultaneously stop the successive appearance of all the numbers, and accept the action proposed by the gaming machine -1-. The gaming machine -1- further comprises a slot for inserting coins -1*a*-, a slot for inserting notes -1*b*-, and a delivery tray -1*c*- of coins ejected from the gaming machine -1- through an outlet -1*d*- when the gaming machine -1- delivers coins when giving a prize or coins for change.

Figure 5:
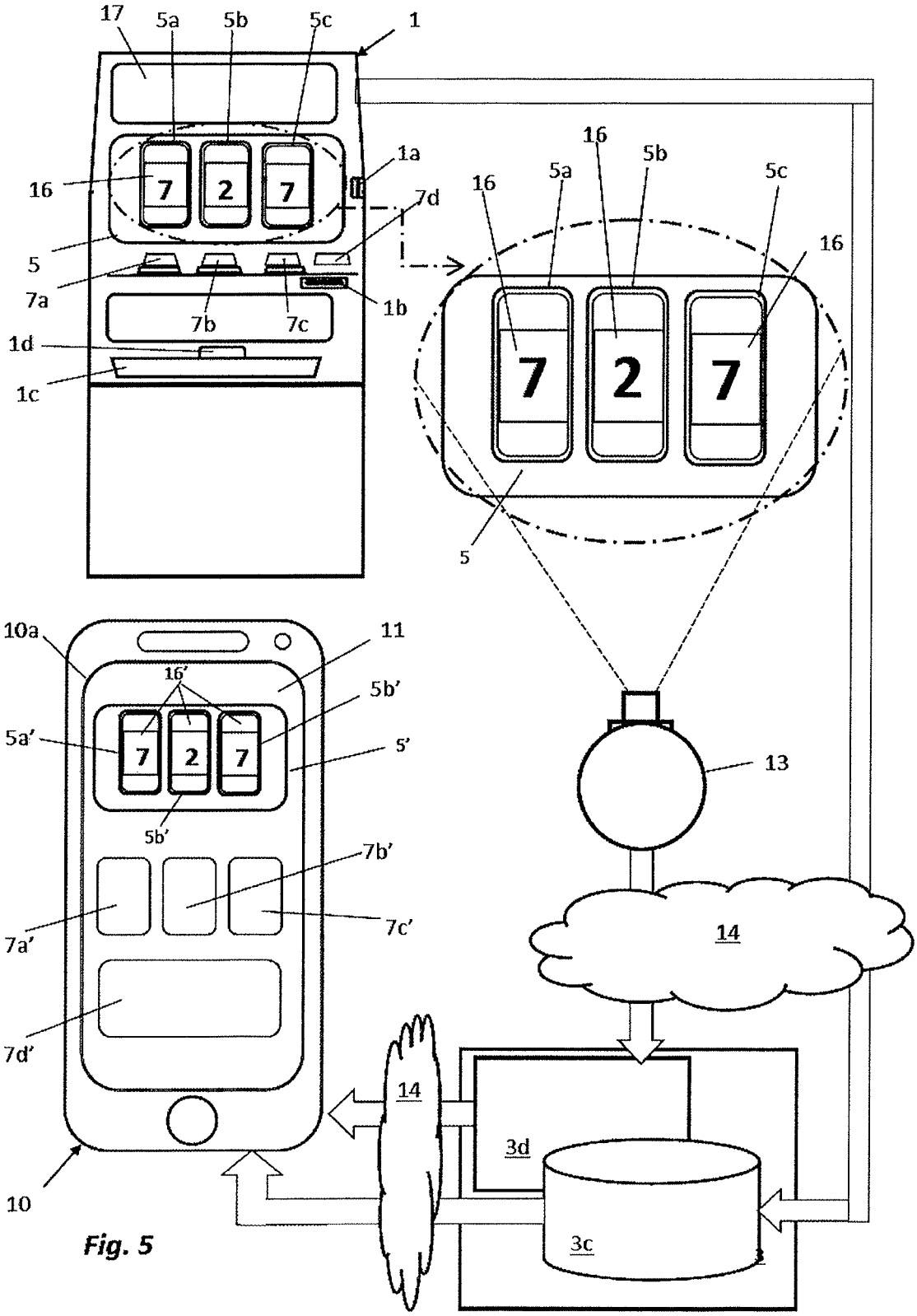
FIG. 5 shows the gaming machine and the remote player terminal, and the flow of data in a first stage of a game session.

In the first stage of the game illustrated in FIG. 5, the remote player has already made, from his remote user terminal -10-, the connection to the remote server -3- and started the game session, so that the rotating rollers -16- and the physical viewing display -5- of the gaming machine -1- show a first combination of numbers in certain positions corresponding to the position signals simultaneously received in the remote user terminal -10-.

The image -5'- of the physical viewing display -5- of the first combination of numbers is captured by the digital camera -13- and transmitted in real time to the video server -3d- on the remote server -3- from where it is transmitted to the remote player terminal -10-, where it is reproduced, also in real time, through a gaming interface -11-, on the screen -10a- of the remote player terminal -10-.

The gaming interface -11- also shows remote selection means -7a', 7b', 7c', 7d'- in the form of three virtual individual selection buttons -7a', 7b, 7c'- and a virtual general selection button -7d'- whose functions are analogous to those of the physical selector means, that is, the physical selector buttons -7a, 7b, 7c, 7d- of the gaming machine -1-. Simultaneously, the position signals corresponding to the image -5'- captured by the status collection means -2d- and transmitted by the status transmission means -12c- are received on the remote player terminal -10-.

Figure 6:
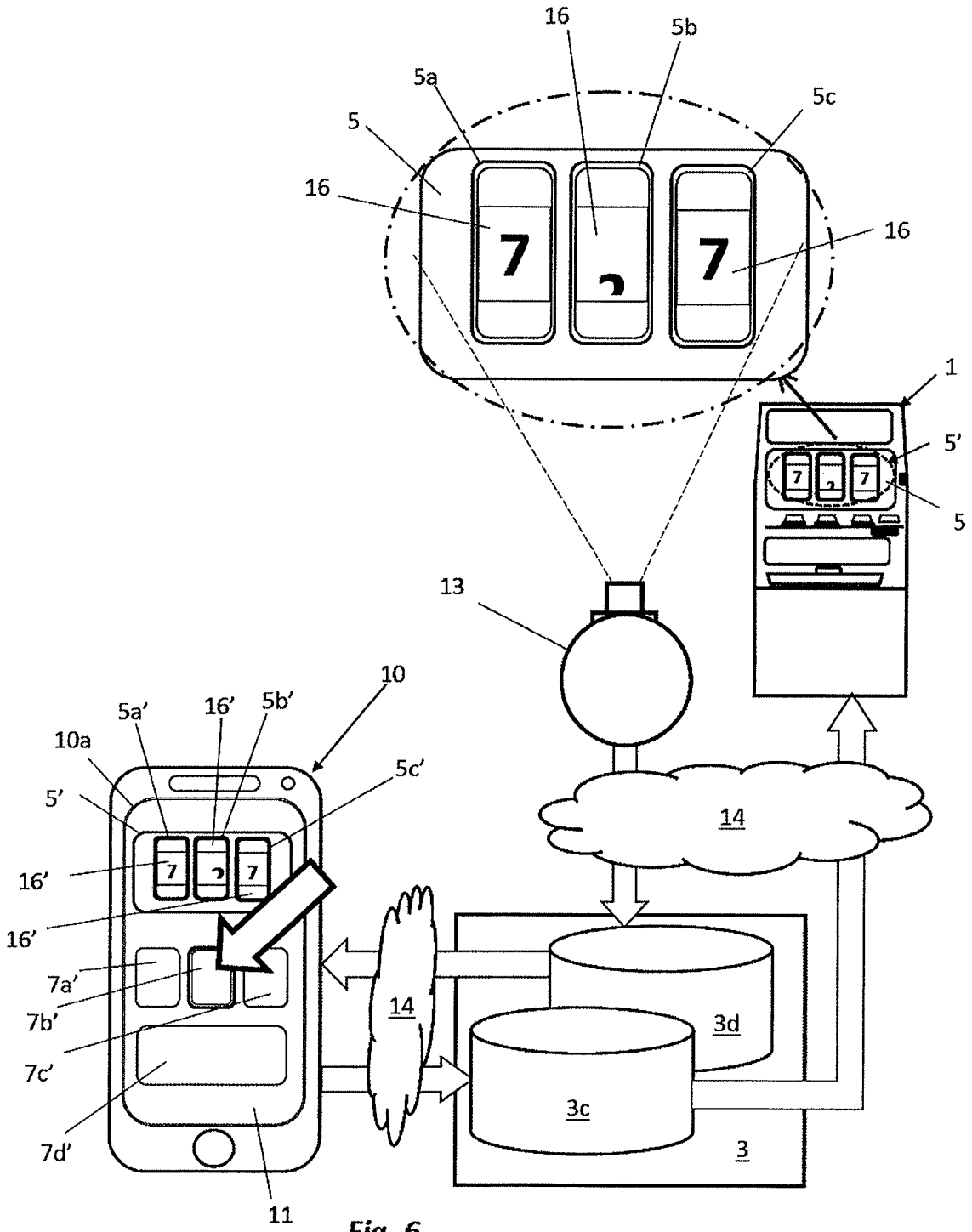
FIG. 6 shows the gaming machine and the remote player terminal, and the flow of data in a second stage of a game session.

In the stage shown in FIG. 6, the remote player has operated the central virtual individual selection button -7b'- to change the number of the central field of the image -5'- of the physical viewing display -5- of the gaming machine -1-. This command is transmitted in real time to the control server -3c- and, from there, also in real time, to the physical gaming machine -1- whose control logic starts, also in real time, the rotation of the roller -16- corresponding to the central field -5b'-, so that the central field -5b- of the physical viewing display -5- of the gaming machine -1- successively and rapidly shows changing numbers. The digital camera -13- captures the images -5'- of the physical viewing display -5- and transmits them in real time to the remote player terminal -10- through the video server -3d- and displays them on the screen -10a- of the remote user terminal -10-.

When the player again presses the central virtual selection button -7b'- in the gaming interface 11- to stop the change of number, this command is transmitted in real time from the remote player terminal -10- to the control server -3c- of the remote server -3- where the selection process means generate the corresponding selection signal that is transmitted to the selection process module of the control module that sends it to the control logic of the gaming machine -1-. The control logic of the gaming machine -1- then stops the rotation of the rotating roller -16- corresponding to the central field -5b- of the physical viewing display and displays a new number in said central field -5b-. The image -5'- showing the new resulting combination of numbers on the physical viewing display -5- of the gaming machine -1- captured by the digital camera -13-, is transmitted to the video server -3d- and, from there, to the remote player terminal -10- where, through the gaming interface -11-, it appears in real time on the screen -10a- of the remote player terminal -10-.

Figure 7:
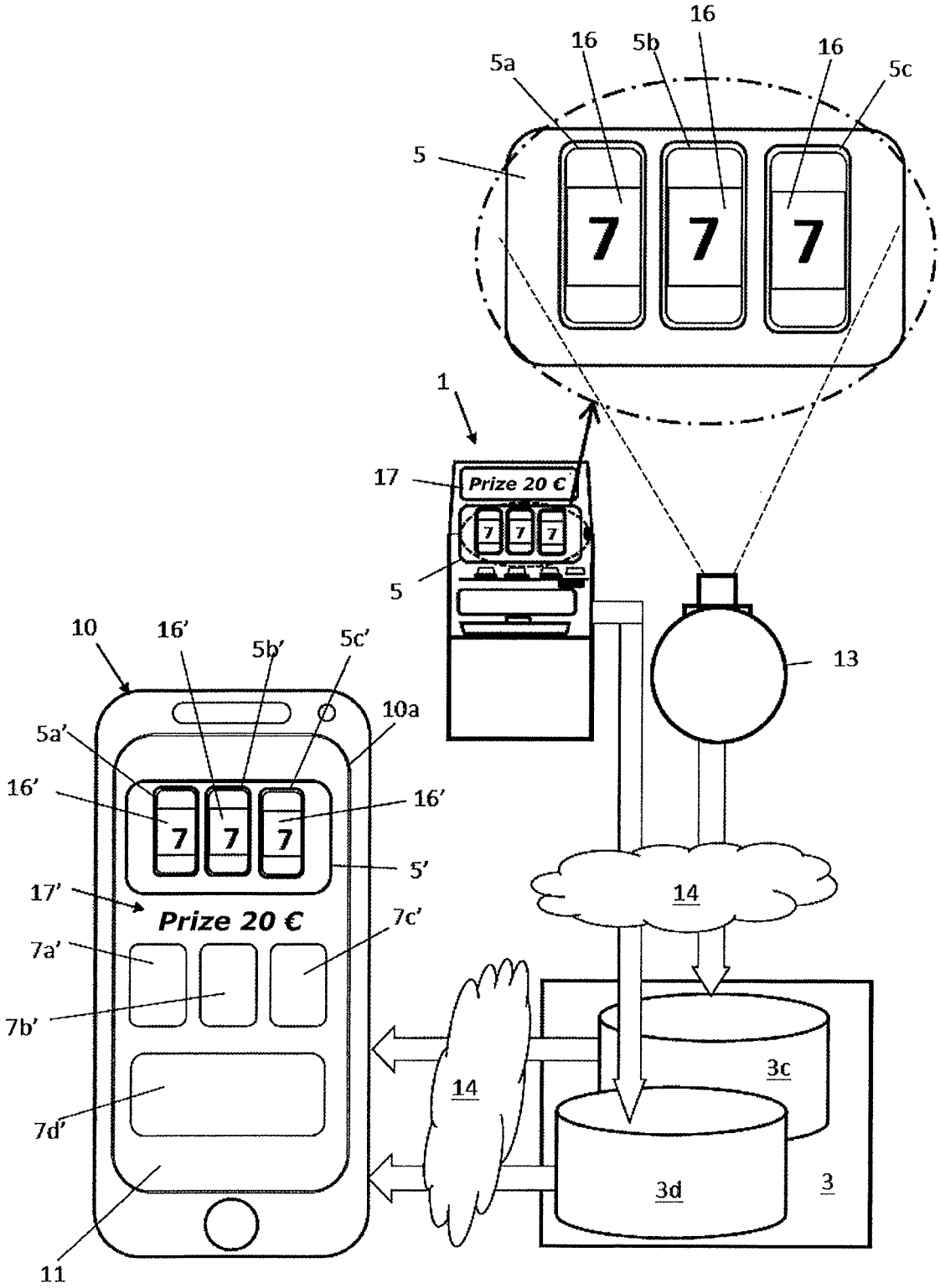
FIG. 7 shows the gaming machine and the remote player terminal, and the flow of data in a third stage of a game session.

In the stage of the game session illustrated in FIG. 7, the change of number in the central field -5b- of the physical viewing display -5- of the gaming machine -1- has resulted in a winning combination whose image -5'- transmitted from the digital camera -13- simultaneously with the corresponding position signals, appears on the screen -10a- of the remote player terminal -10- in real time. Also, the gaming machine -1- shows on its additional electronic screen -17- a message, generated by the control logic of the gaming machine -1-, indicating that it is a winning combination that has a prize of 20 euros This message is transmitted to the control server -3c- and, from there, to the remote user terminal -10- where it appears as an indication -17'- on the screen -10a- of the remote user terminal -10-.

Figure 8:
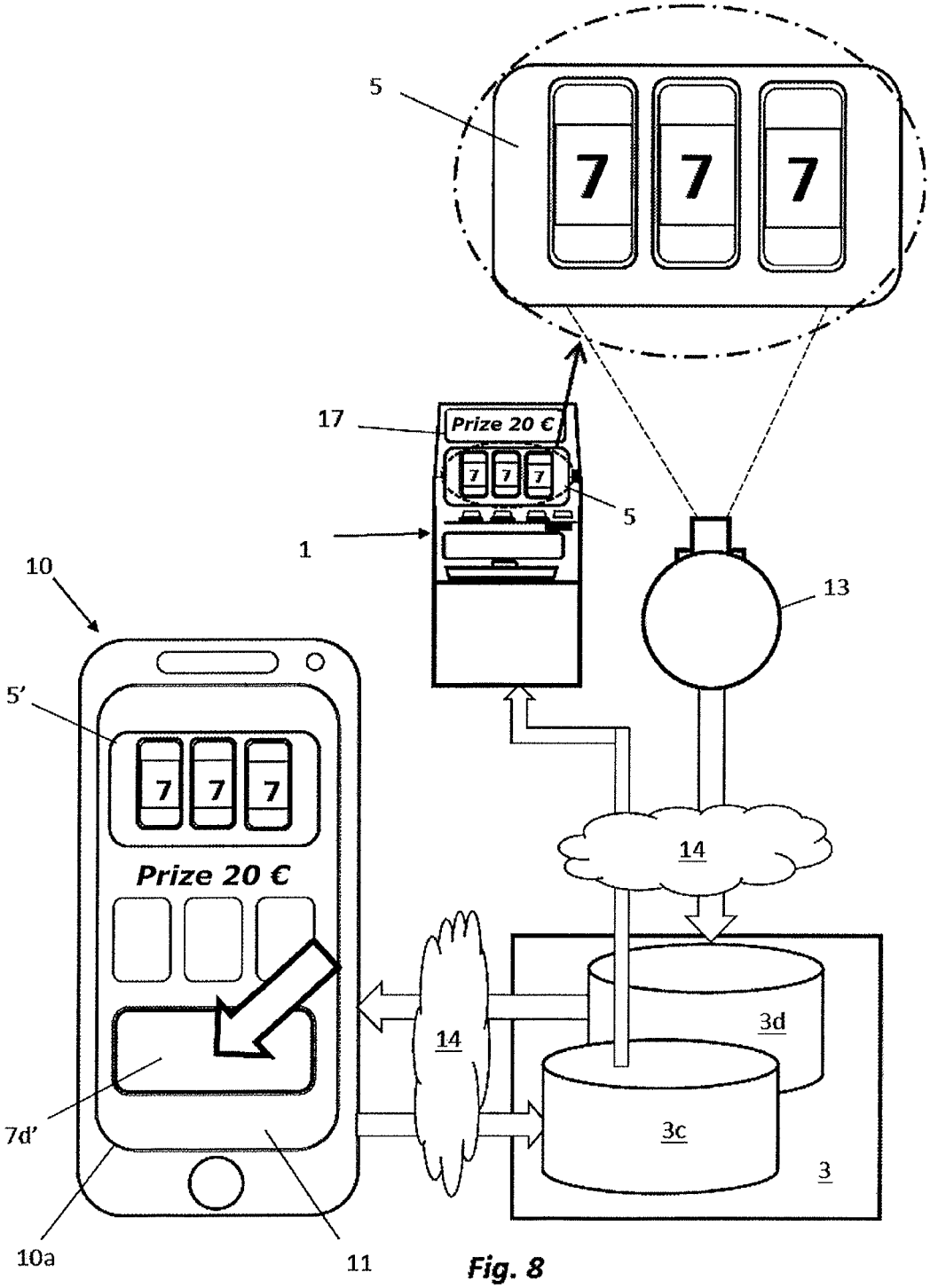
FIG. 8 shows the gaming machine and the remote player terminal, and the flow of data in a fourth stage of a game session.

In the stage of the game session illustrated in FIG. 8, the user has pressed the virtual general selection button -7b'- of the gaming interface -11- on the screen -10a- on his remote player terminal -10- to select a payment command to collect the prize for the winning combination. The payment command is transmitted in real time to the control server -3c- of the remote terminal -3- where the payment collection command is processed in real time by the selection process means for the real-time generation of a payment signal that is sent in real time to the accounts manager module so that it manages the payment of the prize in the account of the remote player, and, also via the control module to the selection process module of the control logic of the gaming machine -1- to that the gaming machine -1- takes note that the remote user has selected payment of the prize.

Figure 9:
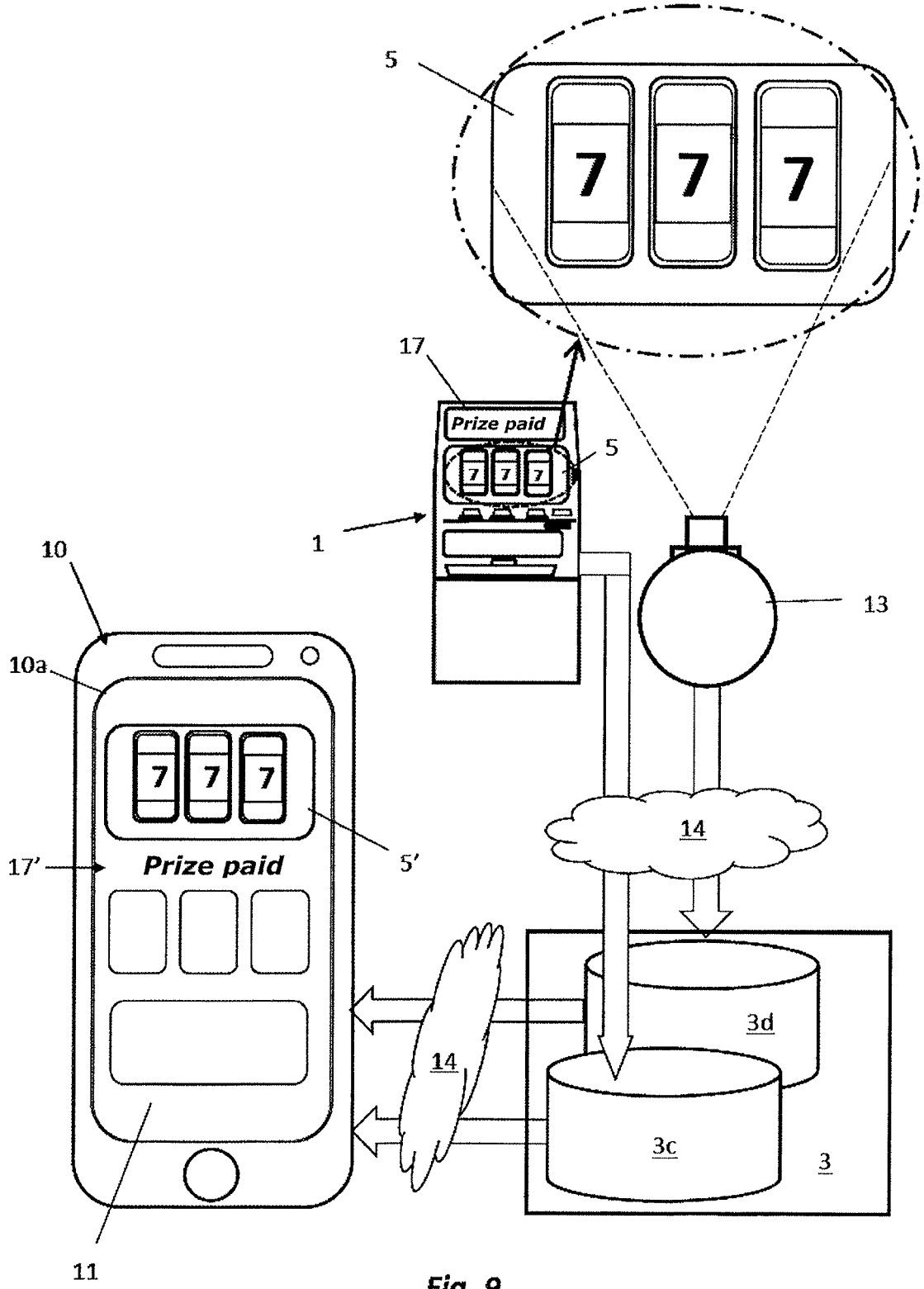
FIG. 9 shows the gaming machine and the remote player terminal, and the flow of data in a fifth stage of a game session.

As illustrated in FIG. 9, when the accounts manager module has paid the prize to the account of the remote user, it generates a payment confirmation signal that the remote server sends in real time to the control module that communicates it to the control logic of the gaming machine so that it shows a payment confirmation message on its additional electronic screen -17-, and to the remote player terminal -10- on whose screen -10a- the gaming interface -11- shows in real time a payment confirmation message -17'- analogous to that shown on the additional electronic screen -17- of the gaming machine -10-. Likewise, the emission of the payment confirmation signal puts the control logic of the gaming machine on stand-by awaiting a new game session that the remote user can initiate.

Figure 10:
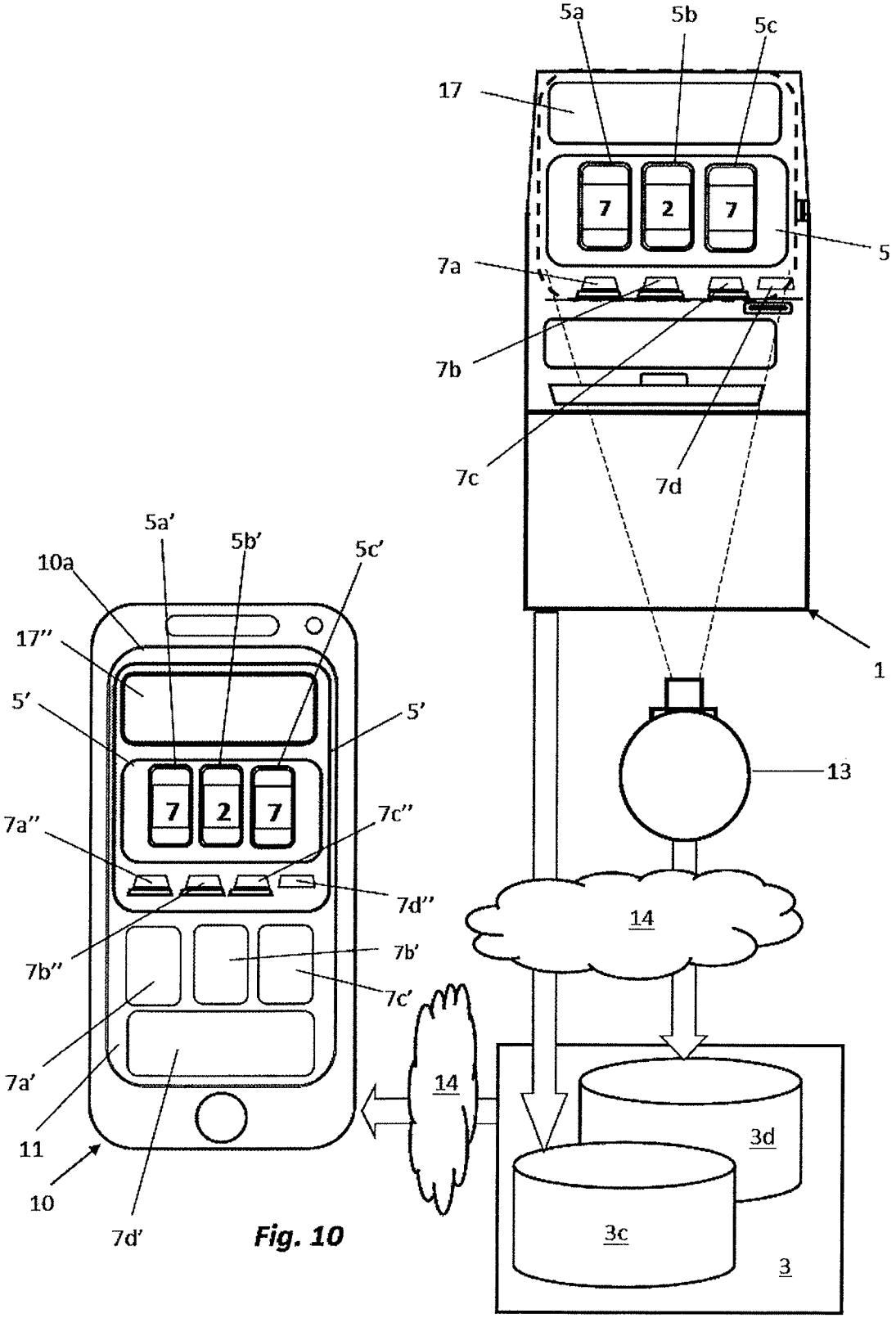
FIG. 10 shows a gaming machine and a remote player terminal, and the flow of data in a first stage of a game session, similar to that illustrated in FIG. 5.

FIG. 10 illustrates a first game stage, analogous to that of FIG. 5, in which the remote player has already made, from his remote user terminal -10-, the connection with the remote server -3- and initiated the game session, so that the physical viewing display -5- of the gaming machine -1- shows a first combination of numbers. In the embodiment illustrated in FIG. 9, the digital camera -13- captures images -5'- not only of the physical viewing display -5- but also of the additional electronic display -17- and of the physical selection buttons -7a, 7b, 7c, 7d- which are reproduced in real time on the screen -10a- of the remote user terminal -10-.

The operation of the control device is completely analogous to that previously described with reference to FIGS. 5 to 9, except without the generation of indications analogous to those shown on the additional electronic screen -17- of the gaming machine -1- transmitted, simultaneously with the corresponding position signals, to the remote player terminal -10- to display them on the screen -10a- thereof, but the images -5'- of those messages shown on the additional electronic screen- 17- are also captured by the digital camera -13- and reproduced on the screen -10a- of the remote user terminal -10- instead of the aforementioned indications, so that the remote user can interact directly with the gaming machine -1- according to the images -5'- captured by the digital camera -13-.

What is claimed is:

1. A control device for controlling operation of at least one physical gaming machine (1) governed by a programmable electronic control logic (2, 2a, 2b, 2c, 2d) in a gaming system, the control device comprising:

a remote server (3); and first telecommunication means (4) to exchange data between the at least one physical gaming machine (1) and the remote server (3), each gaming machine amongst the at least one physical gaming machine (1) comprising a physical viewing display (5) to show an on-site player (6) information on gaming stages, and physical selector means (7*a*, 7*b*, 7*c*, 7*d*) to allow the on-site player (6) to select available on-site commands with respect to a game session of a game, the programmable electronic control logic (2, 2*a*, 2*b*, 2*c*, 2*d*) being configured to process the on-site commands selected by the on-site player (6), activate the gaming machine (1) when an on-site player (6) has paid a price to be able to play the game, capture position signals identifying positions of images displayed on the physical viewing display (5) at each time, and process payment of prizes to the on-site player (6) when the on-site player has won at least one game session of the game from the gaming machine (1), the physical viewing display (5), the physical selector means (7*a*, 7*b*, 7*c*, 7*d*) and the first telecommunication means (4) being connected to the control logic (2);

the control device further comprising:

at least one digital camera (13) arranged to take images (5') in real time of the physical viewing display (5) of the gaming machine (1);

second telecommunication means (9) to perform interactive wireless communications of data related to the game, between the remote server (3) and at least one remote player terminal (10) of a remote player, the second telecommunication means (9) being configured to transmit to the remote player terminal (10) the images (5') of the physical viewing display (5) taken by the digital camera (13);

a gaming interface (11) that, at least when it is in communication with the remote server (3), shows in real time on a screen (10*a*) of the remote player terminal (10) the images transmitted via the second telecommunication means, as well as remote selecting means (7*a*', 7*b*', 7*c*', 7*d*') which are analogous to the physical selector means (7*a*, 7*b*, 7*c*, 7*d*) of the gaming machine (1), the gaming interface (11) further allowing the remote player to select, on the remote player terminal (10), available commands in the gaming stages of the game session of the game and transmit them in real time via the second telecommunication means (9) to the remote server (3), the gaming interface (11) being configured to display on the screen (10*a*) of the remote player terminal (10) the images (5') of the physical viewing display (5);

a control module (12) connected to the control logic (2) of the gaming machine (1) for automatically blocking, when receiving blocking commands from the remote server (3), at least activation of remote selection commands when the gaming machine (1) is activated by an on-site player (6), and for automatically blocking (i) at least activation of the on-site commands, and (ii) activation of on-site play of the gaming machine (1) unless the on-site player (6) has paid the price, and for processing of the payment of prizes to the on-site player (6), and for activating at least the processing of the on-site commands selected by the on-site player (6), in remote gaming mode, when the gaming machine (1) is activated by the remote player; and the remote server (3) being configured to process in real-time commands selected by the remote player in the gaming interface (11) of the remote player terminal (10), and transmit in real-time the selected commands to the control module (12) via the first telecommunication means (4), the remote server (3) comprising:

a control server (3*c*) configured to control functionalities of the system, to store data transmitted between the gaming machine (1) and the remote server (3), the images (5') taken by the digital camera (13), and data transmitted between the remote server (3) and the remote player terminal (10), and to route the images (5') taken by the digital camera (13) to the respective remote player terminals (10) from which the remote players are playing on different gaming machines (1); and a video server (3*d*) configured to collect the images (5') captured by each digital camera (13) and transmit them to respective remote player terminals (10) indicated by the control server (3*c*).

2. The control device according to claim 1, wherein the control module (12, 12*a*, 12*b*) is configured to block at least the activation of the remote selection commands when the gaming machine (1) is activated by an on-site player (6), and to automatically block at least the activation of the on-site commands, the activation of on-site play of the gaming machine (1) when the on-site player (6) has paid the price and the processing of the payment of prizes to the on-site player (6), when the gaming machine (1) is activated by the remote player.

3. The control device according to claim 1, wherein the control module (12) is configured to collect the position signals captured by the electronic control logic (2, 2*d*) identifying the positions of the images displayed on the physical viewing display (5), and transmit the collected signals to the control server (3*c*).

4. The control device according to claim 1, wherein the control module (12) is integrated in the control logic (2) of the gaming machine (1).

5. The control device according to claim 1, wherein the control module (12) is an external unit connected to the control logic (2) of the gaming machine (1).

6. The control device according to claim 1, wherein the digital camera (13) is mounted on the gaming machine (1).

7. The control device according to claim 1, wherein the digital camera (13) is mounted in a location distant from the gaming machine (1).

8. The control device according to claim 1, wherein the first telecommunication means (4) comprise a mobile telephone device.

9. The control device according to claim 1, wherein the first telecommunication means (4) are adapted to establish data traffic with the remote server (3) via a fixed telephone line.

10. The control device according to claim 1, wherein at least part of the gaming interface (11) is programmed in the remote player terminal (10).

11. The control device according to claim 1, wherein at least part of the gaming interface (11) is hosted on the remote server (3) and is only displayed on the remote player terminal (10) when connected to the remote server (3).

12. The control device according to claim 1, wherein the control module (12) comprises a recognition unit programmed to issue a blocking signal which prevents activation of the gaming machine (1) from the remote player terminal (10) when the digital camera (13) does not capture images (5') of the physical viewing display (5) of the gaming machine (1).

13. The control device according to claim 1, wherein the digital camera (13) is a high resolution digital video camera.

14. A gaming installation comprising:

at least one gaming machine (1) governed by a programmable electronic control logic (2) in a gaming system;

a remote server (3);

first telecommunication means (4) to transmit data between the gaming machine (1) and the remote server (3), the gaming machine (1) comprising a physical viewing display (5) to show an on-site player (6) information on gaming stages, and physical selector means (7*a*, 7*b*, 7*c*, 7*d*) to allow the on-site player (6) to select on-site commands available with respect to a game session of a game, the programmable electronic control logic (2) configured to process the on-site commands selected by the on-site player (6), activate the gaming machine (1) when the on-site player (6) has paid a price to be able to play the game, process payout of prizes to the on-site player (6) when the on-site player has won at least one game session of the game from the gaming machine (1), the physical viewing display (5), the physical selector means (7*a*, 7*b*, 7*c*, 7*d*) and the first telecommunication means (4) being connected to the control logic (2);

a control device including at least one digital camera (13) arranged to take images (5') in real time of the physical viewing display (5) of the gaming machine (1);

second telecommunication means (9) to perform interactive wireless communications of data related to the game, between the remote server (3) and at least one remote player terminal (10) of a remote player, the second telecommunication means (9) being configured to transmit to the remote player terminal (10) the images (5') of the physical viewing display (5) taken by the digital camera (13);

a gaming interface (11) that, at least when it is in communication with the remote server (3), shows in real time on a screen (10*a*) of the remote player terminal (10) the images transmitted via the second telecommunication means, as well as remote selecting means (7*a*', 7*b*', 7*c*', 7*d*') which are analogous to the physical selector means (7*a*, 7*b*, 7*c*, 7*d*) of the gaming machine (1), the gaming interface (11) further allowing the remote player to select, on the remote player terminal (10), available commands in the gaming stages of the game session of the game and transmit them in real time via the second telecommunication means (9) to the remote server (3), the gaming interface (11) being configured to display on the screen (10*a*) of the remote player terminal (10) the images (5') of the physical viewing display (5); and a control module (12) connected to the control logic (2) of the gaming machine (1) for automatically blocking, when receiving blocking commands from the remote server (3), at least activation of remote selection commands when the gaming machine (1) is activated by an on-site player (6), and for automatically blocking at least activation of on-site selection commands, and activation of on-site play of the gaming machine (1) unless the on-site player (6) has paid the price, and for processing of the payout of prizes to the on-site player (6), and for activating at least the processing of the on-site commands selected by the on-site player (6), in remote gaming mode, when the gaming machine (1) is activated by the remote player; and wherein the remote server (3) is configured to process, in real-time, commands selected by the remote player in the gaming interface (11) of the remote player terminal (10), and transmit in real-time the processed commands to the control module (12) via the first telecommunication means (4), the remote server (3) comprising a control server (3*c*) configured to control functionalities of the system, to store data transmitted between the gaming machine (1) and the remote server (3), the images (5') taken by the digital camera (13), data transmitted between the remote server (3) and the remote player terminal (10), and to route the images (5') taken by the digital camera (13) to the respective remote player terminals (10) from which the remote players are playing on different gaming machines (1), and a video server (3*d*) configured to collect the images (5') captured by each digital camera (13) and transmit the collected images to respective remote player terminals (10) indicated by the control server (3*c*).

15. The gaming installation according to claim 14, wherein the control module (12) is configured to block at least the activation of the remote selection commands when the gaming machine (1) is activated by an on-site player (6), and to block automatically at least the activation of the on-site selection commands, the activation of on-site play of the gaming machine (1) when the on-site player (6) has paid the price and the processing of the payout of prizes to the on-site player (6), when the gaming machine (1) is activated by the remote player.

16. The gaming installation according to claim 14, wherein the control module (12) is configured to collect the position signals captured by the electronic control logic (2, 2*d*) identifying the positions of the images displayed on the physical viewing display (5), and transmit the collected position signals to the control server (3*c*).

17. The gaming installation according to claim 14, wherein the control module (12) is integrated in the control logic (2) of the gaming machine (1).

18. The gaming installation according to claim 14, wherein the control module (12) is an external unit connected to the control logic (2) of the gaming machine (1).

19. The gaming installation according to claim 14, wherein the digital camera (13) is mounted on the gaming machine (1).

20. The gaming installation according to claim 14, wherein the digital camera (13) is mounted in a location distant from the gaming machine (1).

21. The gaming installation according to claim 14, wherein the first telecommunication means (4) comprise a mobile telephone device.

22. The gaming installation according to claim 14, wherein the first telecommunication means (4) are adapted to establish data traffic with the remote server (3) via a fixed telephone line.

23. The gaming installation according to claim 14, wherein at least part of the gaming interface (11) is programmed in the remote player terminal (10).

24. The gaming installation according to claim 14, wherein at least part of the gaming interface (11) is hosted on the remote server (3) and is only displayed on the remote player terminal (10) when connected to the remote server (3).

25. The gaming installation according to claim 14, wherein the control module (12) comprises a recognition unit programmed to issue a blocking signal which prevents activation of the gaming machine (1) from the remote player terminal (10) when the digital camera (13) does not capture images (5') of the physical viewing display (5) of the gaming machine (1).

26. The gaming installation according to claim 14, wherein the digital camera (13) is a high resolution digital video camera.

* * * * *